United States Patent [19]

Robichaud

[11] 4,287,899

[45] Sep. 8, 1981

[54] NAIL FORM DEVICE

[76] Inventor: Eileen Robichaud, 16 Newhill Rd., Methuen, Mass. 01844

[21] Appl. No.: 153,378

[22] Filed: May 27, 1980

Related U.S. Application Data

[63] Continuation-in-part of Ser. No. 23,908, Mar. 26, 1979.

[51] Int. Cl.[3] ..... A45D 29/00

[52] U.S. Cl. ..... 132/73

[58] Field of Search ..... 132/73

[56] References Cited

U.S. PATENT DOCUMENTS

| | | | |
|---|---|---|---|
| 2,257,102 | 9/1941 | Breene | 132/73 |
| 2,566,852 | 9/1951 | Platt | 132/73 |
| 4,132,234 | 1/1979 | Bradley | 132/73 |

*Primary Examiner*—G. E. McNeill

*Attorney, Agent, or Firm*—Edward A. Gordon

[57] ABSTRACT

The nail form device of the present invention comprises an integral structure having a forward portion and a rearward portion. The forward portion has an upwardly convex surface for supporting the synthetic nail which is to be attached to the natural nail. The rearward portion has a downwardly concave surface for supporting the finger to which the synthetic nail is to be attached. An opening is positioned in the upper portion of the structure and has a forward edge formed by the forward portion and a rearward edge formed by the rearward portion. The opening is adapted to receive the forward portion of a finger with the forward edge of the opening being adapted to insert beneath a portion of the natural nail. The forward portion gradually tapers to smaller dimensions away from the opening, and provides a removable support for the nail extension. The rearward portion is shaped to hold at least the under portion of the forward portion of the finger and cooperates with the opening to position and hold the natural nail for application of the synthetic nail.

10 Claims, 6 Drawing Figures

NAIL FORM DEVICE

This application is a continuation-in-part of my application Ser. No. 23,908 filed Mar. 26, 1979.

FIELD OF THE INVENTION

This invention relates generally to manicuring or pedicuring and more particularly to an improved reusable apparatus facilitating the repairing and extension of natural nails by application of artificial nails to natural nails.

BACKGROUND OF THE INVENTION

In the past, synthetic plastic nails have been deposited or formed on supports such as shields, foils or the like which are inserted beneath the natural nail tip and extend forwardly. Such prior art devices suffer from a number of disadvantages among which are difficulty in holding them in position during the application and hardening of the synthetic nail composition; difficulty and discomfort in positioning the finger and nail in the device; lack of ready adaptability to different finger and nail sizes; and lack of simplicity of construction and use.

It is therefore the desire of this invention to provide a nail form device which is reusable and which overcomes all of such disadvantages and which provides the unusual combinations and subcombinations of advantages in construction, fabrication, mode of operation and adaptability and comfort in operation.

It is also desirable to provide a nail form device which may easily and quickly be applied to a finger or toe to be treated by using only one hand of the operator and which may be easily removed and transferred from one finger or toe to another.

SUMMARY OF THE INVENTION

The nail form device of the present invention comprises an integral structure having a forward portion and a rearward portion. The forward portion has an upwardly convex surface for supporting the synthetic nail which is to be attached to the natural nail. The rearward portion has a downwardly concave surface for supporting the finger to which the synthetic nail is to be attached. An opening is positioned in the upper portion of the structure and has a forward edge formed by the forward portion and a rearward edge formed by the rearward portion. The opening is adapted to receive the forward portion of a finger with the forward edge of the opening being adapted to insert beneath a portion of the natural nail. The forward portion gradually tapers to smaller dimensions away from the opening, and provides a removable support for the nail extension. The rearward portion is shaped to hold at least the under portion of the forward portion of the finger and cooperates with the opening to position and hold the natural nail for application of the synthetic nail. As will be seen, the material used to form the nail form device may be any of a variety of materials, preferably molded plastic, that there should be little or no adhesion between the nail form and nail extending material and that the form be flexible but relatively stiff to provide support. In another embodiment of the invention, the forward and rearward portions are separate members which are held in slidable relationship to each other to allow extension of the device to fit fingers of different lengths.

BRIEF DESCRIPTION OF THE DRAWINGS

For a fuller understanding of the nature and desired objects of the inventions, reference should be had to the following detailed description taken in connection with the accompanying drawing wherein like reference characters refer to corresponding parts throughout the several views and wherein.

DETAILED DESCRIPTION

Figure 1:
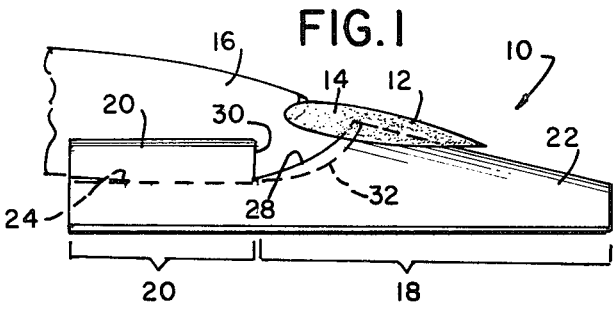
FIG. 1 is a side plan view of a nail form device embodying the present invention and showing the device in use.
Figure 2:
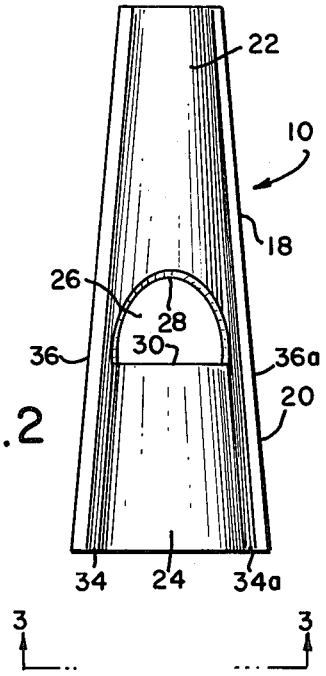
FIG. 2 is a top plan view of the nail form device of FIG. 1 except that it is not in use.
Figure 3:
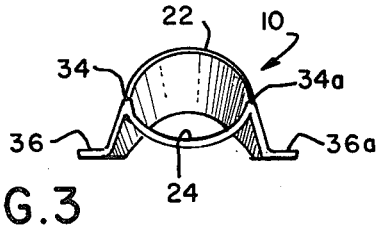
FIG. 3 is an end view on lines 3—3 of FIG. 2.

In FIGS. 1–3 of the drawing the illustrated device of the present invention includes a form 10 of integral structure used in aiding attachment of a synthetic nail 12 to a natural nail 14 as shown on a finger 16. The synthetic plastic paste or liquid may be applied to the natural nail and on the form so that the final product appears as in FIG. 1. A suitable applicator would, for example, be a brush applicator (not shown) well known to those skilled in art. Suitable synthetic materials are well known to those skilled in the art and include liquid plastics such as acrylics and a material known as "porcelain" which is usually supplied in the form of a liquid component and a powder component which are mixed to form a paste like material which is applied with a brush or other applicator to the end of the nail to be extended.

The form 10 has a forward portion shown generally at 18 and a rearward portion shown generally at 20. The forward portion has an upwardly convex surface 22 for supporting the synthetic nail 12. The rearward portion 20 has a downwardly concave surface 24 for supporting the finger 16 to which the synthetic nail 12 is to be attached. The forward portion 20 tapers forwardly both laterally and vertically but more laterally than vertically. The upper surface of form 10 is provided with an opening 26 adapted to receive the forward portion 32 of the finger 16. The opening 26 has a forward edge 28 formed by convex surface 22 and curves generally downwardly, sidewardly and rearwardly as best seen in FIGS. 1 and 2. The rearward edge 30 of opening 26 is formed by the concave surface 24 and conforms to the concave configuration and is best seen in FIGS. 2 and 3. The opening 26 formed in this manner is adapted to receive the forward portion 32 of finger 16 and facilitates the insertion of the forward edge 28 of opening 26 beneath a portion of the natural nail 14. The concave surface 24 and the rolled edges 34, **34*a* of the rearward portion 20 and opening 26, cooperate to maintain the finger in position during application of the synthetic nail. The form 10 is preferably provided with flanges 36 and 36*a* which provide support for and stabilize the form 10** on a supporting surface.

The material used to construct form 10 may be any of a variety of materials, preferably molded plastic. The forms will be flexible in part, but relatively stiff to provide adequate support for the finger and nail to be extended. Preferably the rearward portion 20 is sufficiently flexible whereby when the finger is inserted and the form placed on a supporting surface, the flanges 36 and 36*a*, with slight downward pressure of the finger, will cause the rolled edges 34 and 34*a* to laterally resiliently grip the finger therebetween and hold it in position. The forward portion 18 is sufficiently resiliently flexible whereby lateral pressure on either side below the synthetic nail will provide assistance in removing the nail from the form as a result of any adhesion of the synthetic nail material and the form. The removable and reusable nail forms of the present invention are preferably provided with a smooth surface, the main requirement being that there should be little or no adhesion between the form and the nail extension materials. Suitable plastic materials are, for example, a tetrafluoroethylene product such as TEFLON.

Figure 4:
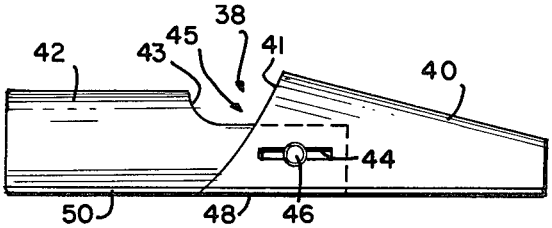
FIG. 4 is a side plan view of a modified form of the invention showing a two piece construction.

Referring now to FIG. 4 of the drawing, there is illustrated a modified form 38 of the nail form of FIG. 1. In this embodiment, the forward member 40 and rearward member 42 are separate members and are constructed and arranged to move in sliding telescopic relationship to each other with the forward member 42 preferably slidably moving within forward member 40. Means are provided to hold the forward and rearward members in slidable relationship to each other and comprise a longitudinal slot 44 carried by forward member 28 and a guide and holding pin 46 carried by rearward member 42. The flanges 48 of forward member 40 slides upon flange 50 of rearward member 42 and maintains the members in level relationship to each other. In this manner the nail form 38 may be extended or contracted to accomodate fingers or toes of varying lengths. In this embodiment edges 41 and 43 cooperate to form opening 45 similar to opening 26 of FIG. 1.

Figure 5:
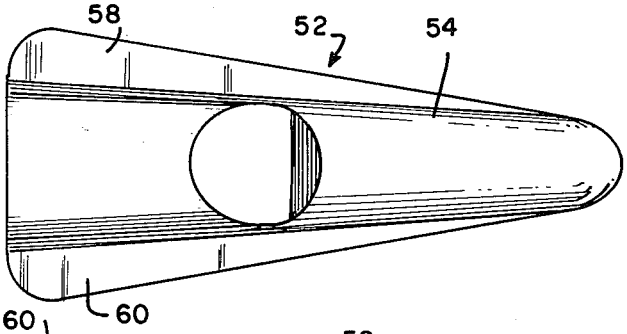
FIG. 5 is a top plan view of a modified embodiment of the invention showing the forward portion of the device as being enclosed, and the rearward portion having flared sides for gripping and supporting.
Figure 6:
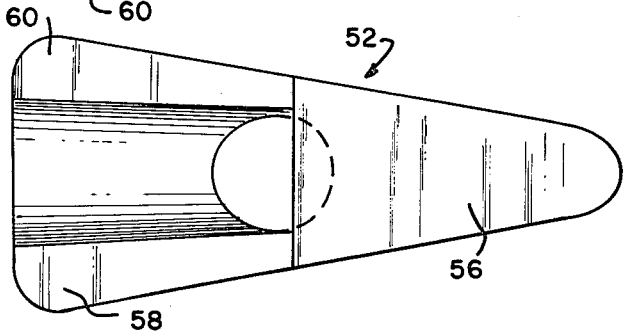
FIG. 6 is a bottom plan view of FIG. 5.

Referring now to FIGS. 5 and 6 there is illustrated, a modified embodiment of the nail form 52 of the present invention. In this embodiment the forward portion 54 is enclosed and is provided with at least a partial flat bottom surface 56 to provide a hollow structure and to give additional forward support against a supporting surface. Additionally, the flanges 58 and 60 are flared laterally rearwardly to provide additional gripping surfaces whereby adjacent fingers, for example, may hold the form on a supporting surface such as a table or the like.

It will be apparent from the foregoing description that the present invention provides a significant advantage in the care and treatment of fingernails since it provides such features as comfortable accomodation of various size fingers, quick fitting and removal, easy and convenient operation by one hand and maintenance of proper position of finger and nail in the form.

While the invention has been described with respect to preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrated and not in limiting sense.

What is claimed is:

1. A device for forming and attaching a synthetic fingernail to a natural nail comprising, an integral structure having a forward portion and a rearward portion, said forward portion having an upwardly convex surface for supporting the synthetic nail which is to be attached to the natural nail, the rearward portion having a downwardly concave surface for supporting the finger to which the synthetic nail is to be attached, and an opening positioned in the upper portion of said structure having a forward edge formed by said forward portion and a rearward edge formed by said rearward portion, said opening being adapted to receive the forward portion of said finger, the forward edge of said opening being adapted to insert beneath a portion of said natural nail.

2. The device as set forth in claim 1, wherein said integral structure is provided at its lower portion with flanged portions for supporting said structure.

3. The device as set forth in claim 2 wherein said flanged portions are outturned.

4. The device as set forth in claim 2 wherein said flanged portions are flared laterally rearwardly.

5. The device as set forth in claim 1 wherein said forward portion is enclosed and has at least a partial flat bottom surface.

6. The device as set forth in claim 1 wherein said convex surface is resiliently flexible to lateral pressure and said concave surface has rolled surfaces and is resiliently flexible.

7. A device for forming and attaching a synthetic fingernail to a natural nail comprising, an integral structure having a forward portion and a rearward portion, said forward portion having an upwardly convex surface for supporting the synthetic nail which is to be attached to the natural nail, the rearward portion having a downwardly concave surface for supporting the finger to which the synthetic nail is to be attached, and an opening positioned in the upper portion of said structure having a forward edge formed by said forward portion and a rearward edge formed by said rearward portion, said opening being adapted to receive the forward portion of said finger, the forward edge of said opening being adapted to insert beneath a portion of said natural nail, said concave surface having rolled edges and being resiliently flexible so as to laterally grip said finger and hold it in position in said opening.

8. The device as set forth in claim 7 wherein said convex surface of said forward portion is resiliently flexible to lateral pressure at least adjacent to said said synthetic fingernail.

9. A device for forming and attaching a synthetic fingernail to a natural nail comprising, a forward member and a rearward member, said forward member having an upwardly convex surface for supporting the synthetic nail which is to be attached to the natural nail, the rearward member having a downwardly concave surface for supporting the finger to which the synthetic nail is to be attached, said forward member having a rear edge curved downwardly, sidewardly and rearwardly to receive the forward portion of said finger below said edge and a portion of said natural nail above said edge, and means to hold said forward and rearward members in slidable relationship to each other.

10. The device as set forth in claim 9 wherein said forward and rearward members have flanged surfaces, said surfaces being in slidable relationship to each other and provide a supporting surface for said members.

* * * * *